US009351379B2

(12) United States Patent
Nian et al.

(10) Patent No.: US 9,351,379 B2
(45) Date of Patent: May 24, 2016

(54) INTEGRATED LIGHT-EMITTING DIODE DRIVER CIRCUIT AND METHOD OF OPERATING THE SAME

(71) Applicant: DELTA ELECTRONICS, INC., Taoyuan County (TW)

(72) Inventors: Chia-Jung Nian, Taoyuan County (TW); Ching-Ho Chou, Taoyuan County (TW)

(73) Assignee: DELTA ELECTRONICS, INC. (TW)

( * ) Notice: Subject to any disclaimer, the term of this patent is extended or adjusted under 35 U.S.C. 154(b) by 0 days.

(21) Appl. No.: 14/587,753

(22) Filed: Dec. 31, 2014

(65) Prior Publication Data

US 2016/0007428 A1 Jan. 7, 2016

(30) Foreign Application Priority Data

Jul. 4, 2014 (TW) ..... 103123233 A

(51) Int. Cl.
*H05B 33/08* (2006.01)
*H05B 37/02* (2006.01)

(52) U.S. Cl.
CPC ..... *H05B 37/0263* (2013.01); *H05B 33/0809* (2013.01); *H05B 33/0821* (2013.01); *H05B 33/0845* (2013.01)

(58) Field of Classification Search
CPC ..... H05B 33/0815; H05B 33/0851
USPC ..... 315/291, 297, 307, 224, 192
See application file for complete search history.

(56) References Cited

U.S. PATENT DOCUMENTS

2008/0018261 A1* 1/2008 Kastner ..... F21V 23/00 315/192
2010/0244726 A1* 9/2010 Melanson ..... H02M 3/33523 315/291
2011/0101876 A1 5/2011 Jheng et al.
2011/0133655 A1* 6/2011 Recker ..... H02J 9/02 315/159
2011/0291585 A1* 12/2011 Foo ..... H05B 33/0815 315/291

(Continued)

FOREIGN PATENT DOCUMENTS

KR 20130135419 12/2013
TW 201336345 9/2013

(Continued)

OTHER PUBLICATIONS

European search report dated Apr. 10, 2015 from corresponding No. EP 14199952.4.

(Continued)

*Primary Examiner* — Douglas W Owens
*Assistant Examiner* — Syed M Kaiser
(74) *Attorney, Agent, or Firm* — Hauptman Ham, LLP

(57) ABSTRACT

An integrated light-emitting diode (LED) driver circuit includes a bi-directional power line communication (PLC) unit, a power conversion module, and a constant current (CC)/constant voltage (CV) control unit. The bi-directional PLC unit receives an AC voltage, and converts a modulation signal on the AC voltage to generate a light-dimming control signal. The power conversion module receives the AC voltage and converts the AC voltage to generate an output voltage. The CC/CV control unit receives the light-dimming control signal to generate a dimming constant current or a dimming constant voltage. The integrated LED driver circuit outputs the dimming constant current or the dimming constant voltage and the output voltage to drive a LED string.

14 Claims, 6 Drawing Sheets

(56) References Cited

U.S. PATENT DOCUMENTS

| | | | | |
|---|---|---|---|---|
| 2012/0139426 | A1 | 6/2012 | Ilyes et al. | |
| 2012/0212143 | A1* | 8/2012 | Esaki | H05B 33/089 315/192 |
| 2013/0193879 | A1* | 8/2013 | Sadwick | H05B 33/0818 315/307 |
| 2013/0293139 | A1* | 11/2013 | Sadwick | H05B 37/02 315/224 |
| 2014/0265935 | A1* | 9/2014 | Sadwick | H05B 33/0848 315/307 |
| 2014/0285101 | A1* | 9/2014 | Kitamura | H05B 33/08 315/200 R |
| 2014/0306614 | A1* | 10/2014 | Pan | H05B 33/0824 315/193 |
| 2015/0028761 | A1* | 1/2015 | Vonach | H05B 33/0815 315/201 |

FOREIGN PATENT DOCUMENTS

| | | |
|---|---|---|
| TW | 201336346 | 9/2013 |
| TW | 201406204 | 2/2014 |
| TW | 201410075 | 3/2014 |

OTHER PUBLICATIONS

Office Action dated Nov. 17, 2015 from corresponding No. TW 103123233.

* cited by examiner

INTEGRATED LIGHT-EMITTING DIODE DRIVER CIRCUIT AND METHOD OF OPERATING THE SAME

BACKGROUND

1. Technical Field

The present disclosure relates generally to a light-emitting diode driver circuit and a method of operating the same, and more particularly to an integrated light-emitting diode driver circuit and a method of operating the same.

2. Description of Related Art

The power line communication (PLC) carries data on a conductor that is also used simultaneously for AC electric power transmission or electric power distribution to consumers. The 50/60-Hz AC power is used to be the carrier wave and then the high-frequency (about KHz or MHz) modulated single is added to the wiring system. On the contrary, the signal on the power line is decoupled to filter the 50/60-Hz AC power and then the filtered signal is demodulated and amplified. The power line communication technology is implemented without additional network lines, and the covered area of the power line communication is much larger than that of other carriers.

Reference is made to FIG. 1 which is a schematic block diagram of a related art light-emitting diode (LED) driver system of a first embodiment. The LED driver system mainly includes a light-dimming control conversion unit 10A, a light-emitting diode (LED) driver circuit 20A, and a light-emitting diode (LED) string 30A. The LED driver system receives an AC voltage Vac and converts the AC voltage Vac to drive the LED string 30A. The LED driver circuit 20A includes a power conversion unit 202A, a light-dimming control interface 204A, a constant current/constant voltage control unit 206A, and a rectifying and filtering unit 208A. In particular, the LED driver circuit 20A is integrated into a modular design but the light-dimming control conversion unit 10A is externally connected to the LED driver circuit 20A.

The light-dimming control conversion unit 10A is connected to the LED driver circuit 20A and converts a modulation signal on the AC voltage Vac to generate a constant light-dimming voltage Vdim or a PWM light-dimming signal Vpwm. In particular, the labeled "Vdim+" and "Vdim−" indicate the positive and negative terminals of the constant light-dimming voltage Vdim, respectively. Also, the light-dimming levels are adjusted according to the voltage magnitude of the constant light-dimming voltage Vdim. In addition, the labeled "Vpwm+" and "Vpwm−" indicate the positive and negative terminals of the PWM light-dimming signal Vpwm. The PWM light-dimming signal Vpwm is a digital signal with the positive and negative levels, and the light-dimming levels are adjusted according to the duty cycle of the PWM light-dimming signal Vpwm. The live wire voltage provides a live wire input voltage $V_{Li}$ and a live wire output voltage $V_{Lo}$, and the light-dimming control conversion unit 10A receives the live wire input voltage $V_{Li}$ and outputs the live wire output voltage $V_{Lo}$ so that the modulation signal is acquired. Also, the live wire output voltage $V_{Lo}$ is connected to the LED driver circuit 20A to supply power to the LED driver circuit 20A. In the conventional LED driver system, the LED driver circuit 20A has a light-dimming control interface 204A for receiving the constant light-dimming voltage Vdim generated from the light-dimming control conversion unit 10A. Also, the light-dimming control interface 204A generates the light-dimming control signal (not shown). After the constant current/constant voltage control unit 206A receives the light-dimming control signal, the LED driver circuit 20A outputs a driving voltage $V_{LED}$ to provide a constant-current or constant-voltage light-dimming control. In particular, the labeled "$V_{LED+}$" and "$V_{LED-}$" indicate the positive and negative terminals of the driving voltage $V_{LED}$, respectively. In this embodiment, the light-dimming control interface 204A can be a 0-10 volt dimming control interface. The uni-directional constant light-dimming voltage Vdim or PWM light-dimming signal Vpwm provides the uni-directional light-dimming control to the LED string 30A by the 0-10 volt dimming control interface.

Reference is made to FIG. 2 which is a schematic block diagram of the related art light-emitting diode driver system of a second embodiment. The major difference between the second embodiment and the first embodiment is that the LED driver system can provide a bi-directional light-dimming control. Therefore, the LED driver circuit 20A is a digital addressable lighting interface (DALI). The bi-directional constant light-dimming voltage Vdim generated from the light-dimming control conversion unit 10A provides the bi-directional light-dimming control to the LED string 30A by the DALI.

In the both first embodiment and second embodiment, the control signal has to be converted into the specified signal of DALI, 0-10 volt, or PWM, and then the converted signal is provided to control the current signal at the output side (LED side). Because the control interfaces are separated and isolated, and the light-dimming signal is converted by multiple converters, such as PLC to DALI, or PLC to 0-10 volts, the losses are increased and the conversion efficiency is reduced. In addition, the size and occupied space are increased and the costs are also increased because the conversion circuits are installed. Furthermore, the additional circuit wires and increased working hours are unavoidable because the light-dimming control conversion unit 10A is externally connected to the LED driver circuit 20A.

Accordingly, it is desirable to provide an integrated light-emitting diode driver circuit and a method of operating the same to implement the bi-directional light-dimming function, the absence of the DALI dimming control interface or 0-10 volt dimming control interface, the reduced size and occupied space, lower costs, and higher conversion efficiency.

SUMMARY

An object of the present disclosure is to provide an integrated light-emitting diode driver circuit to solve the above-mentioned problems. Accordingly, the integrated light-emitting diode driver circuit receives an AC voltage and converts the AC voltage to drive a light-emitting diode string. The integrated light-emitting diode driver circuit includes a bi-directional power line communication unit, a power conversion module, and a constant current/constant voltage control unit. The bi-directional power line communication unit receives the AC voltage and converts a modulation signal on the AC voltage to generate a light-dimming control signal. The power conversion module receives the AC voltage and converts the AC voltage to generate an output voltage. The constant current/constant voltage control unit receives the light-dimming control signal to generate a constant light-dimming current or a constant light-dimming voltage. The integrated light-emitting diode driver circuit outputs the constant light-dimming current or the constant light-dimming voltage and the output voltage to drive the light-emitting diode string.

Another object of the present disclosure is to provide a method of operating an integrated light-emitting diode driver circuit to solve the above-mentioned problems. Accordingly, the integrated light-emitting diode driver circuit receives an AC voltage and converts the AC voltage to drive a light-emitting diode string. The method includes steps of (a) providing a bi-directional power line communication unit, the bi-directional power line communication unit receiving the AC voltage and converting a modulation signal on the AC voltage to generate a light-dimming control signal; (b) providing a power conversion module, the power conversion module receiving the AC voltage and converting the AC voltage to generate an output voltage; (c) providing a constant current/constant voltage control unit, the constant current/constant voltage control unit receiving the light-dimming control signal to generate a constant light-dimming current or a constant light-dimming voltage; and (d) outputting the constant light-dimming current or the constant light-dimming voltage and the output voltage by the integrated light-emitting diode driver circuit to drive the light-emitting diode string.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The features of the present disclosure believed to be novel are set forth with particularity in the appended claims. The present disclosure itself, however, may be best understood by reference to the following detailed description of the present disclosure, which describes an exemplary embodiment of the present disclosure, taken in conjunction with the accompanying drawings, in which:

DETAILED DESCRIPTION

Figure 1:
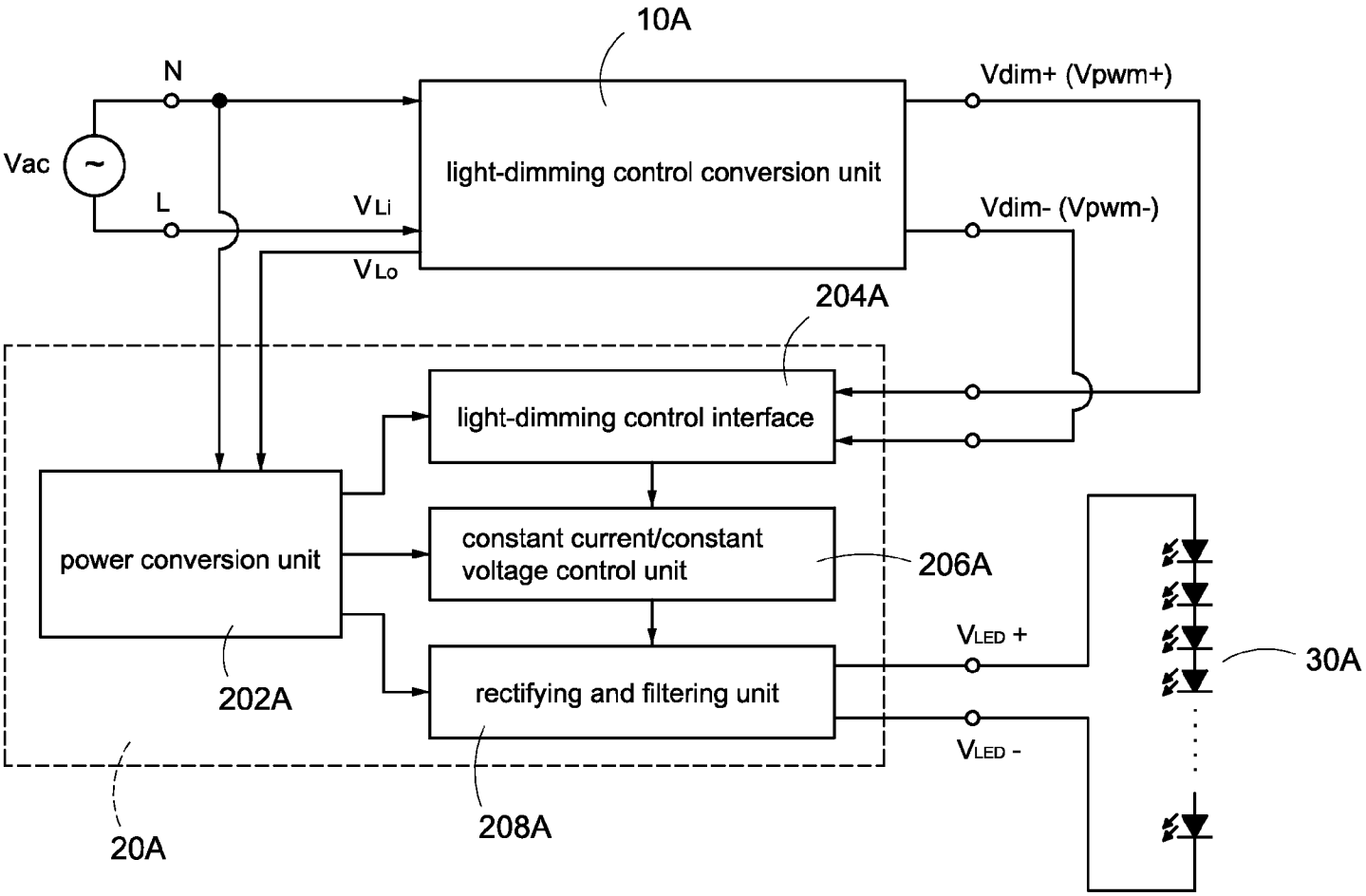
FIG.1 (Related Art)
FIG. 1 is a schematic block diagram of a related art light-emitting diode driver system of a first embodiment.

Reference will now be made to the drawing figures to describe the present invention in detail.

Figure 3:
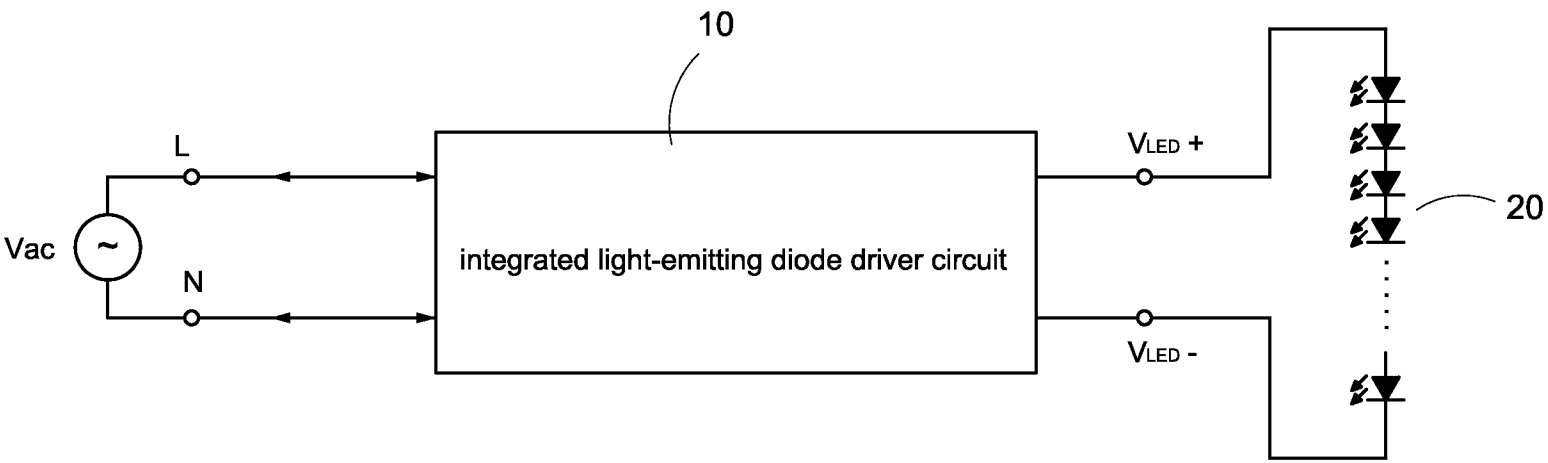
FIG. 3 is a schematic block diagram of an integrated light-emitting diode driver circuit for driving a light-emitting diode string according to the present disclosure.

Reference is made to FIG. 3 which is a schematic block diagram of an integrated light-emitting diode (LED) driver circuit for driving a light-emitting diode (LED) string according to the present disclosure. The integrated LED driver circuit directly receives an external AC voltage Vac and converts the AC voltage Vac to generate a driving voltage $V_{LED}$ to drive the LED string 20. The LED driver circuit has two main features:

1. The LED driver circuit is integrated into a modular design; and

2. The integrated LED driver circuit provides a bi-directional light-dimming control function.

Figure 4:
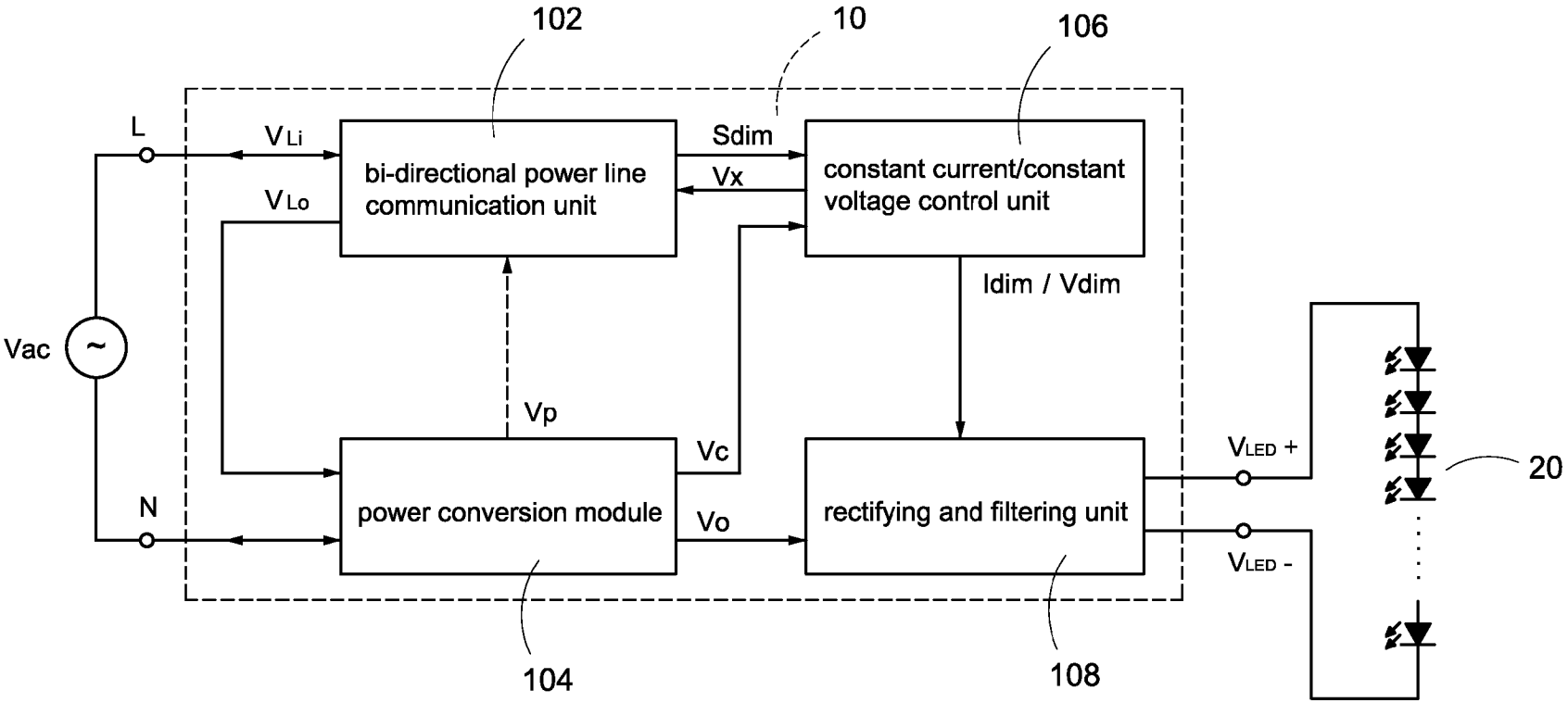
FIG. 4 is a schematic block diagram of the integrated light-emitting diode driver circuit according to a first embodiment of the present disclosure.

Reference is made to FIG. 4 which is a schematic block diagram of the integrated light-emitting diode driver circuit according to a first embodiment of the present disclosure. The integrated light-emitting diode (LED) driver circuit 10 receives an AC voltage Vac and converts the AC voltage Vac to drive a light-emitting diode (LED) string 20. The integrated LED driver circuit 10 includes a bi-directional power line communication (PLC) unit 102, a power conversion module 104, and a constant current (CC)/constant voltage (CV) control unit 106. The bi-directional PLC unit 102 receives a live wire input voltage $V_{Li}$ of the AC voltage Vac and converts a modulation signal on the AC voltage Vac to generate a light-dimming control signal Sdim. The power conversion module 104 receives a live wire output voltage $V_{Lo}$ of the AC voltage Vac and converts the live wire output voltage $V_{Lo}$ to generate an output voltage Vo. In particular, the live wire output voltage $V_{Lo}$ is generated by the bi-directional PLC unit 102. The CC/CV control unit 106 receives the light-dimming control signal Sdim to generate a constant light-dimming current Idim or a constant light-dimming voltage Vdim. In particular, the integrated LED driver circuit 10 outputs the constant light-dimming current Idim or the constant light-dimming voltage Vdim and the output voltage Vo to drive the LED string 20. Especially, the bi-directional PLC unit 102 can be an isolated or non-isolated PLC device. If the bi-directional PLC unit 102 is the isolated PLC device, the power conversion module 104 can also generate a conversion voltage Vp to the primary side of the bi-directional PLC unit 102.

In addition, the integrated LED driver circuit 10 further includes a rectifying and filtering unit 108. The rectifying and filtering unit 108 receives the constant light-dimming current Idim or the constant light-dimming voltage Vdim and the output voltage Vo to rectify and filter the constant light-dimming current Idim or the constant light-dimming voltage Vdim and the output voltage Vo and output a driving voltage $V_{LED}$ to drive the LED string 20. The detailed operation of the integrated LED driver circuit 10 will be described hereinafter as follows.

Figure 5:
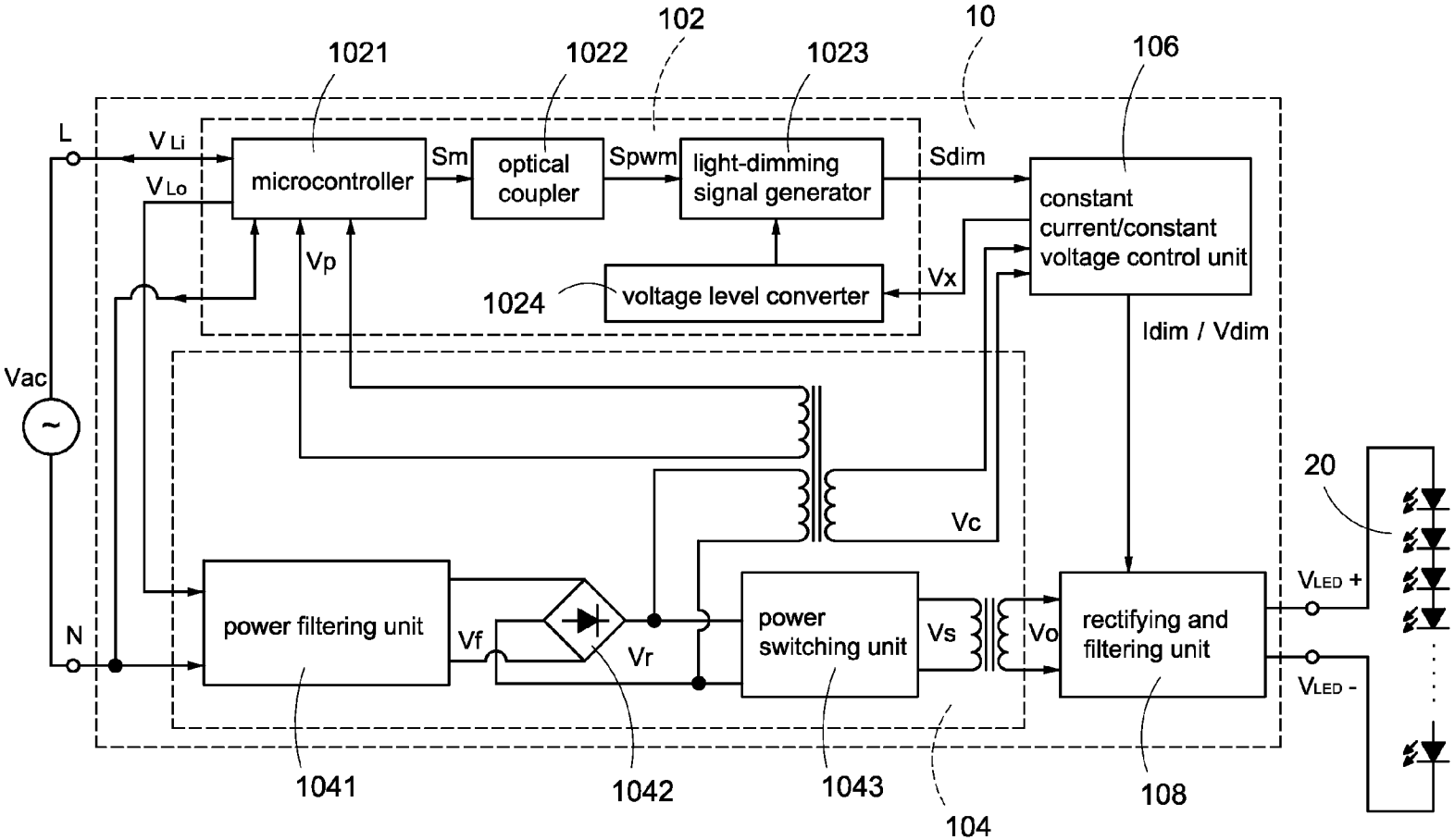
FIG. 5 is a schematic block diagram of the integrated light-emitting diode driver circuit according to a second embodiment of the present disclosure.

Reference is made to FIG. 5 which is a schematic block diagram of the integrated light-emitting diode driver circuit according to a second embodiment of the present disclosure. FIG. 5 illustrates the detailed block diagram in FIG. 4. More specifically, the bi-directional PLC unit 102 includes a microcontroller 1021, an optical coupler 1022, and a light-dimming signal generator 1023. The microcontroller 1021 receives the live wire input voltage $V_{Li}$ of the AC voltage Vac to generate a voltage signal Sm and receives the conversion voltage Vp to provide the required voltage for the microcontroller 1021. The optical coupler 1022 receives the voltage signal Sm and converts the voltage signal Sm to output a modulation signal Spwm. The light-dimming signal generator 1023 receives the modulation signal Spwm to generate the light-dimming control signal Sdim. In addition, the bi-directional PLC unit 102 further includes a voltage level converter 1024. The voltage level converter 1024 converts a supplying voltage Vx outputted from the CC/CV control unit 106 to provide the required voltage for the light-dimming signal generator 1023.

In addition, the power conversion module 104 includes a power filtering unit 1041, a full-wave rectifying unit 1042, a power switching unit 1043, and a main transformer 1044. The power filtering unit 1041 receives the live wire output voltage $V_{Lo}$ outputted from the microcontroller 1021 to filter electromagnetic noises in the live wire output voltage $V_{Lo}$ to output a filtering voltage Vf. The full-wave rectifying unit 1042 receives the filtering voltage Vf and rectifies the filtering voltage Vf to output a rectifying voltage Vr. The power switching unit 1043 receives the rectifying voltage Vr and convers the rectifying voltage Vr to output a switching voltage Vs. In particular, the power switching unit 1043 is controlled by an external pulse-width modulation (PWM) signal and provides the power factor correction (PFC) function. The main transformer receives the switching voltage Vs and converts the switching voltage Vs to output the output voltage Vo. In addition, the power conversion module 104 further includes an auxiliary transformer 1045. The auxiliary transformer 1045 receives the rectifying voltage Vr and converts the rectifying voltage Vr to output a control voltage Vc to provide the required voltage for the constant current/constant voltage control unit 106.

Figure 2:
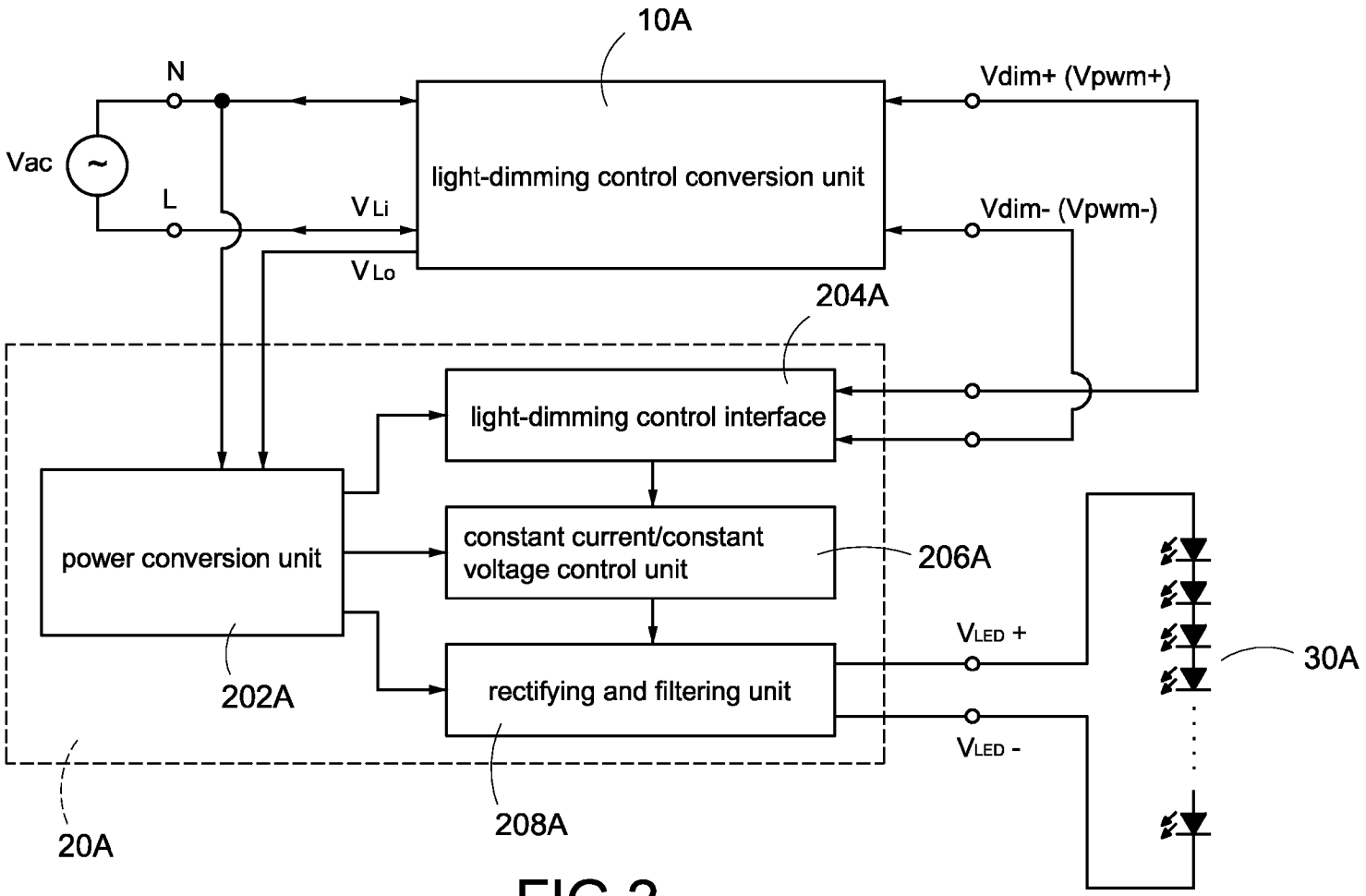
FIG.2 (Related Art)
FIG. 2 is a schematic block diagram of the related art light-emitting diode driver system of a second embodiment.

Especially, the bi-directional PLC unit 102, the power conversion module 104, the constant current/constant voltage control unit 106, and the rectifying and filtering unit 108 of the integrated LED driver circuit 10 are integrated and modularized. That is, the light-dimming control system and the power-supplying system for the LED string 20 are integrated into a modular design to dim and supply power to the LED string 20. More specifically, the light-dimming control signal Sdim generated from the bi-directional PLC unit 102 is used to implement the light-dimming function. Therefore, the required specified voltage for the light-dimming signal can be directly acquired during the operation of converting and processing the AC voltage Vac and outputting the light-dimming control signal Sdim by the microcontroller 1021, the optical coupler 1022, the light-dimming signal generator 1023, and the voltage level converter 1024. Unlike the conventional light-emitting diode driver system (as shown in FIG. 1 and FIG. 2), the light-dimming control conversion unit 10A is externally connected to the light-emitting diode driver circuit 20A so that the control interfaces are separated and isolated. In addition, the light-dimming signal is converted by multiple converters. In the present disclosure, the required specified voltage for the light-dimming signal can be directly acquired by the bi-directional PLC unit 102 and the power conversion module 104 in the modular design. In other words, the bi-directional PLC unit 102 is used instead of the DALI dimming control interface or 0-10 volt dimming control interface in the conversional light-emitting diode driver system.

Figure 6:
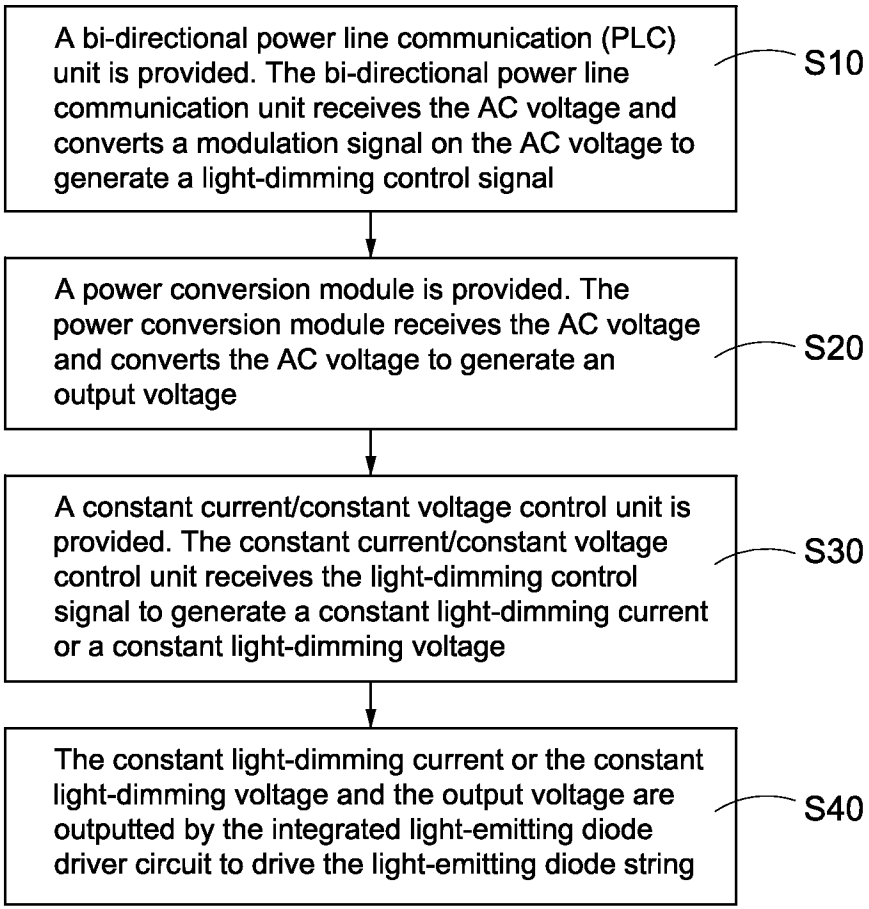
FIG. 6 is a flowchart of a method of operating an integrated light-emitting diode driver circuit according to the present disclosure.

Reference is made to FIG. 6 which is a flowchart of a method of operating an integrated light-emitting diode driver circuit according to the present disclosure. The integrated light-emitting diode driver circuit receives an AC voltage and converts the AC voltage to drive a light-emitting diode string. The method includes steps as follows. First, a bi-directional power line communication (PLC) unit is provided. The bi-directional power line communication unit receives the AC voltage and converts a modulation signal on the AC voltage to generate a light-dimming control signal (S10). The bi-directional PLC unit includes a microcontroller, an optical coupler, and a light-dimming signal generator. The microcontroller receives the AC voltage to generate a voltage signal and receives a conversion voltage to provide the required voltage for the microcontroller. The optical coupler receives the voltage signal and converts the voltage signal to output a modulation signal. The light-dimming signal generator receives the modulation signal to generate the light-dimming control signal.

Afterward, a power conversion module is provided. The power conversion module receives the AC voltage and converts the AC voltage to generate an output voltage (S20). The power conversion module includes a power filtering unit, a full-wave rectifying unit, a power switching unit, and a main transformer. The power filtering unit receives the AC voltage outputted from the microcontroller to filter electromagnetic noises in the AC voltage to output a filtering voltage. The full-wave rectifying unit receives the filtering voltage and rectifies the filtering voltage to output a rectifying voltage. The power switching unit receives the rectifying voltage and converts the rectifying voltage to output a switching voltage. In particular, the power switching unit is controlled by an external pulse-width modulation (PWM) signal and provides the power factor correction (PFC) function. The main transformer receives the switching voltage and converts the switching voltage to output the output voltage.

Afterward, a constant current/constant voltage control unit is provided. The constant current/constant voltage control unit receives the light-dimming control signal to generate a constant light-dimming current or a constant light-dimming voltage (S30). In particular, the integrated LED driver circuit outputs the constant light-dimming current or the constant light-dimming voltage and the output voltage to drive the LED string. In addition, the power conversion module further includes an auxiliary transformer. The auxiliary transformer receives the rectifying voltage and converts the rectifying voltage to output a control voltage to provide the required voltage for the constant current/constant voltage control unit. In addition, the bi-directional PLC unit further includes a voltage level converter. The voltage level converter converts a supplying voltage outputted from the CC/CV control unit to provide the required voltage for the light-dimming signal generator.

Finally, the constant light-dimming current or the constant light-dimming voltage and the output voltage are outputted by the integrated light-emitting diode driver circuit to drive the light-emitting diode string (S40).

In addition, the method further includes a step of: providing a rectifying and filtering unit. The rectifying and filtering unit receives the constant light-dimming current or the constant light-dimming voltage and the output voltage to rectify and filter the constant light-dimming current or the constant light-dimming voltage and the output voltage and output a driving voltage to drive the light-emitting diode string.

Especially, the bi-directional PLC unit, the power conversion module, the constant current/constant voltage control unit, and the rectifying and filtering unit of the integrated LED driver circuit are integrated and modularized. That is, the light-dimming control system and the power-supplying system for the LED string are integrated into a modular design to dim and supply power to the LED string. More specifically, the light-dimming control signal generated from the bi-directional PLC unit is used to implement the light-dimming function. Therefore, the required specified voltage for the light-dimming signal can be directly acquired during the operation of converting and processing the AC voltage and outputting the light-dimming control signal by the microcontroller, the optical coupler, the light-dimming signal generator, and the voltage level converter.

In conclusion, the present disclosure has following advantages:

1. The bi-directional PLC unit 102, the power conversion module 104, the constant current/constant voltage control unit 106, and the rectifying and filtering unit 108 are integrated and modularized to reduce size and occupied space, and reduce costs;

2. The bi-directional PLC unit 102 is used instead of the DALI dimming control interface or 0-10 volt dimming control interface as well as provides the bi-directional light-dimming function; and 3. The required specified voltage for the light-dimming signal can be directly acquired by the bi-directional PLC unit 102 and the power conversion module 104 in the modular design so as to reduce losses and increase the conversion efficiency because of the absence of multiple voltage or signal conversion circuits.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. An integrated light-emitting diode driver circuit, comprising:

a bi-directional power line communication unit comprising a microcontroller, the microcontroller being configured to receive an AC voltage and a conversion voltage as an operation voltage of the microcontroller, and to generate a voltage signal based on the AC voltage, the bi-directional powerline communication unit being configured to convert the voltage signal to generate a modulation signal and to generate a light-dimming control signal based on the modulation signal;

a power conversion module configured to receive the AC voltage and to convert the AC voltage to generate an output voltage; and a constant current/constant voltage control unit configured to receive the light-dimming control signal and to generate a constant light-dimming current or a constant light-dimming voltage, wherein the integrated light-emitting diode driver circuit is configured to output the constant light-dimming current or the constant light-dimming voltage and to output the output voltage to drive a light-emitting diode string configured to be driven by the light-emitting diode driver circuit.

2. The integrated light-emitting diode driver circuit of claim 1, further comprising:

a rectifying and filtering unit configured to receive the constant light-dimming current or the constant light-dimming voltage and the output voltage, and to rectify and filter the constant light-dimming current or the constant light-dimming voltage and the output voltage to generate a driving voltage to drive the light-emitting diode string.

3. The integrated light-emitting diode driver circuit of claim 1, wherein the bi-directional power line communication unit further comprises:

an optical coupler configured to receive the voltage signal and to convert the voltage signal to generate the modulation signal; and a light-dimming signal generator configured to receive the modulation signal to generate the light-dimming control signal.

4. The integrated light-emitting diode driver circuit of claim 3, wherein the power conversion module comprises:

a power filtering unit configured to receive the AC voltage from the microcontroller to filter electromagnetic noises in the AC voltage and to output a filtering voltage;

a full-wave rectifying unit configured to receive the filtering voltage, to rectify the filtering voltage, and to output a rectifying voltage;

a power switching unit configured to receive the rectifying voltage and to convert the rectifying voltage to output a switching voltage; and a main transformer configured to receive the switching voltage and to convert the switching voltage to output the output voltage.

5. The integrated light-emitting diode driver circuit of claim 3, wherein the bi-directional power line communication unit further comprises:

a voltage level converter configured to convert a supplying voltage output by the constant current/constant voltage control unit to an operation voltage of the light-dimming signal generator.

6. The integrated light-emitting diode driver circuit of claim 4, wherein the power conversion module further comprises:

an auxiliary transformer configured to receive the rectifying voltage and and to convert the rectifying voltage to output a control voltage as an operation voltage of the constant current/constant voltage control unit.

7. The integrated light-emitting diode driver circuit of claim 2, wherein the bi-directional power line communication unit, the power conversion module, the constant current/constant voltage control unit, and the rectifying and filtering unit are integrated into a module.

8. A method of operating an integrated light-emitting diode driver circuit, the method comprising:

generating a voltage signal based on a received AC voltage, the voltage signal being generated by a microcontroller of a bi-directional power line communication unit configured to receive the AC voltage and a conversion voltage, the conversion voltage being an operation voltage of the microcontroller;

generating a light-dimming control signal based on a modulation signal generated by the bi-directional power line communication unit, the modulation signal being generated based on the voltage signal;

converting the AC voltage to generate an output voltage, the output voltage being generated by a power conversion module configured to receive the AC voltage;

generating a constant light-dimming current or a constant light-dimming voltage by a constant current/constant voltage control unit configured to receive the light-dimming control signal; and outputting the constant light-dimming current or the constant light-dimming voltage and the output voltage from the integrated light-emitting diode driver circuit to drive a light-emitting diode string configured to be driven by the light-emitting diode driver circuit.

9. The method of operating the integrated light-emitting diode driver circuit of claim 8, further comprising:

rectifying and filtering the constant light-dimming current or the constant light-dimming voltage and the output voltage by a rectifying and filtering unit to generate a driving voltage to drive the light-emitting diode string.

10. The method of operating the integrated light-emitting diode driver circuit of claim 8, wherein an optical coupler of the bi-directional power line communication unit receives the voltage signal and converts the voltage signal to generate the modulation signal; and a light-dimming signal generator of the bi-directional power line communication unit receives the modulation signal to generate the light-dimming control signal.

11. The method of operating the integrated light-emitting diode driver circuit of claim 8, wherein a power filtering unit of the power conversion module receives the AC voltage from the microcontroller to filter electromagnetic noises in the AC voltage to output a filtering voltage;

a full-wave rectifying unit of the power conversion module receives the filtering voltage and rectifies the filtering voltage to output a rectifying voltage;

a power switching unit of the power conversion module receives the rectifying voltage and converts the rectifying voltage to output a switching voltage; and a main transformer of the power conversion module receives the switching voltage and converts the switching voltage to output the output voltage.

12. The method of operating the integrated light-emitting diode driver circuit of claim 10, wherein a voltage level converter of the bi-directional power line communication unit converts a supplying voltage output by the constant current/constant voltage control unit to an operation voltage of the light-dimming signal generator.

13. The method of operating the integrated light-emitting diode driver circuit of claim 11, wherein an auxiliary transformer of the power conversion module receives the rectifying voltage and converts the rectifying voltage to output a control voltage as an operation voltage of the constant current/constant voltage control unit.

14. The method of operating the integrated light-emitting diode driver circuit of claim 9, wherein the driving voltage is output to the light-emitting diode string from an integrated module comprising the bi-directional power line communication unit, the power conversion module, the constant current/constant voltage control unit, and the rectifying and filtering unit.

* * * * *